US009373455B2

(12) United States Patent
Knospe et al.

(10) Patent No.: US 9,373,455 B2
(45) Date of Patent: Jun. 21, 2016

(54) SPRING-OPERATED MECHANISM HAVING DELAY CIRCUIT

(75) Inventors: Jörg Knospe, Bruchköbel (DE); Henrik Lohrberg, Frankfurt (DE); Joachim Eggers, Hanau (DE); Franz-Josef Körber, Altenstadt (DE); Thomas Brenneis, Mainaschaff (DE)

(73) Assignee: ABB TECHNOLOGY AG, Zürich (CH)

( * ) Notice: Subject to any disclaimer, the term of this patent is extended or adjusted under 35 U.S.C. 154(b) by 186 days.

(21) Appl. No.: 13/366,056

(22) Filed: Feb. 3, 2012

(65) Prior Publication Data

US 2012/0193201 A1 Aug. 2, 2012

Related U.S. Application Data

(63) Continuation of application No. PCT/EP2010/004559, filed on Jul. 26, 2010.

(30) Foreign Application Priority Data

Aug. 3, 2009 (DE) ..... 10 2009 035 889
Sep. 14, 2009 (CN) ..... 2009 2 0169964

(51) Int. Cl.
*G04F 1/00* (2006.01)
*G04F 3/02* (2006.01)
(Continued)

(52) U.S. Cl.
CPC ..... *H01H 3/3015* (2013.01); *H01H 3/3031* (2013.01); *H01H 71/44* (2013.01)

(58) Field of Classification Search
CPC . H01H 3/3005; H01H 3/3015; H01H 3/3031; H01H 3/32; H01H 3/3052; H01H 2003/3078; H01H 7/00; H01H 7/08; H01H 71/44
USPC ..... 200/33 R, 33 B; 335/59–67
See application file for complete search history.

(56) References Cited

U.S. PATENT DOCUMENTS 2,820,860 A * 1/1958 Kozikowski et al. ..... 200/39 R
4,180,788 A 12/1979 Barkan
(Continued)

FOREIGN PATENT DOCUMENTS

DE 43 40 533 A1 6/1995
DE 10 2006 041 250 A1 3/2008
(Continued)

OTHER PUBLICATIONS

International Search Report (PCT/ISA/210) issued on Nov. 15, 2010, by European Patent Office as the International Searching Authority for International Application No. PCT/EP2010/004559.

*Primary Examiner* — Renee Luebke
*Assistant Examiner* — Lheiren Mae A Caroc
(74) *Attorney, Agent, or Firm* — Buchanan Ingersoll & Rooney PC

(57) ABSTRACT

A hydromechanical stored-energy spring mechanism is provided for operating at least one switching contact of a circuit breaker, for example, in a high-voltage switching system. The hydromechanical stored-energy spring mechanism includes a hydraulically operated close-open (CO) delay circuit configured to delay triggering of a switching process of the circuit breaker, and an electromechanical actuator provided in place of a hydraulic operation of the CO delay circuit. The electromechanical actuator generates a mechanical time delay or acceleration over an extended temperature range.

14 Claims, 1 Drawing Sheet

(51) Int. Cl.

| | |
|---|---|
| ***G04F 3/06*** | (2006.01) |
| ***H01H 3/30*** | (2006.01) |
| *H01H 71/44* | (2006.01) |

(56) References Cited

U.S. PATENT DOCUMENTS

| | | | | |
|---|---|---|---|---|
| 4,297,554 | A | 10/1981 | Rueth, Jr. | |
| 8,053,695 | B2 * | 11/2011 | Sohn | 200/334 |
| 2008/0053801 | A1 | 3/2008 | Korber | |
| 2008/0296138 | A1 | 12/2008 | Chen et al. | |

FOREIGN PATENT DOCUMENTS

| | | | |
|---|---|---|---|
| DE | 10 2008 061238 | A1 | 7/2010 |
| EP | 1 998 354 | A1 | 12/2008 |
| GB | 2 067 838 | A | 7/1981 |
| JP | A-62-264535 | | 11/1987 |
| JP | A-2009-135115 | | 6/2009 |

* cited by examiner

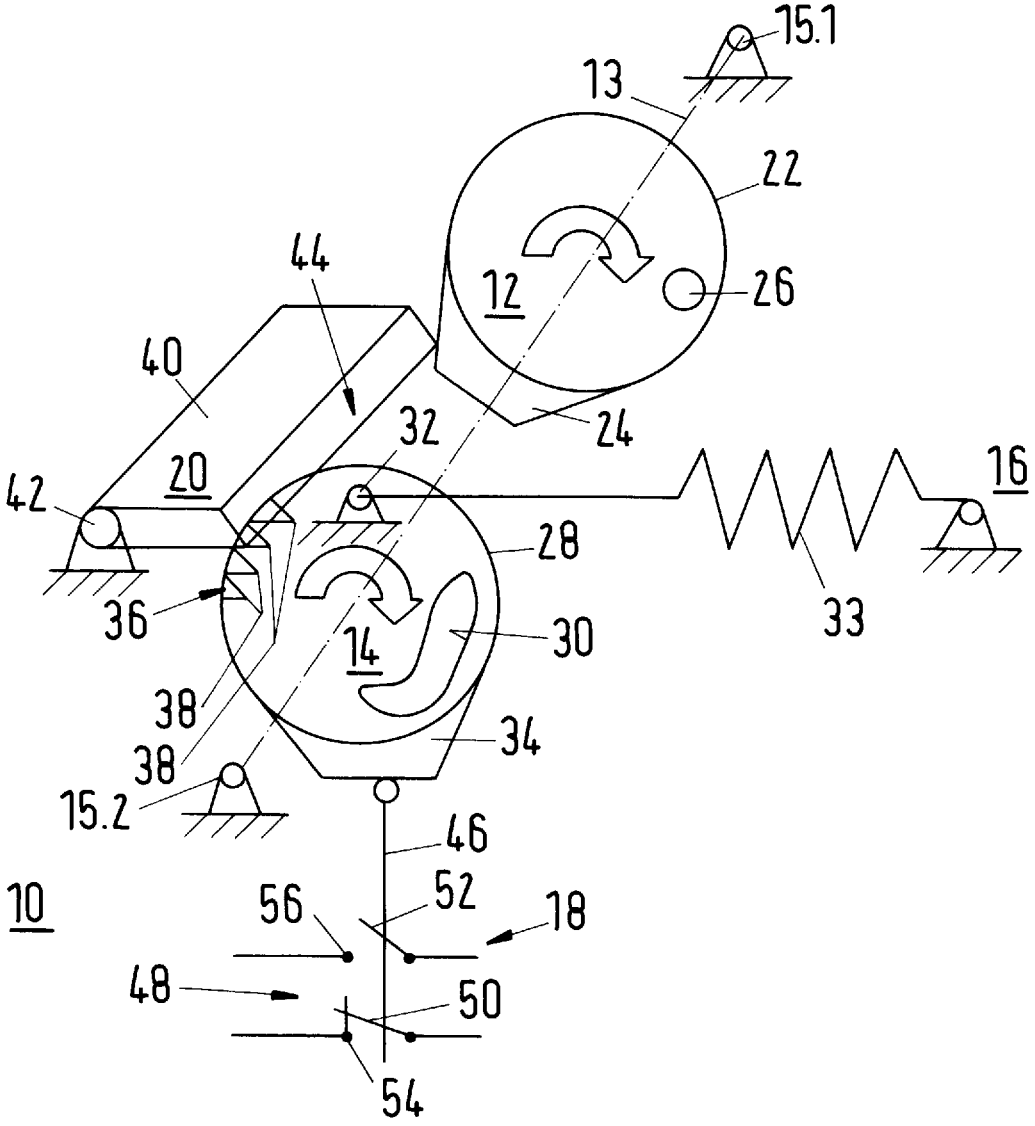
15.1
13
22
44
12
26
40
24
32
20
16
42
28
36
33
30
14
38
34
38
15.2
46
10
56
52
18
48
50
54

SPRING-OPERATED MECHANISM HAVING DELAY CIRCUIT

RELATED APPLICATION

This application claims priority as a continuation application under 35 U.S.C. §120 to PCT/EP 2010/004559, which was filed as an International Application on Jul. 26, 2010 designating the U.S., and which claims priority to German Application No. 10 2009 035 889.7 filed on Aug. 3, 2009 and Chinese Application No. 200920169964.3 filed on Sep. 14, 2009. The entire contents of these applications are hereby incorporated by reference in their entireties.

FIELD

The present disclosure relates to a hydromechanical stored-energy spring mechanism for operating at least one switching contact of a circuit breaker, for example, in a high-voltage switching system. More particularly, the present disclosure relates to a hydromechanical stored-energy spring mechanism which includes a hydraulically operated CO (close-open) delay circuit that delays triggering of the switching process of the circuit breaker.

BACKGROUND INFORMATION

It is generally known that hydromechanical stored-energy spring mechanisms are used for activating switching contacts, for example, in high-voltage switching systems. The hydromechanical stored-energy spring mechanisms are provided with a generally hydraulically operated CO (close-open) delay circuit. This delay circuit is intended to use a time delay to ensure controlled opening of the respective switching contact and possibly of auxiliary contacts.

It is also generally known that hydraulically operated CO (close-open) delay circuits of this kind are highly susceptible to temperature influences, that is to say they ensure compliance with the respectively intended, required constant time delay only within a narrow temperature interval. The current generation of CO time delay circuits, which are hydraulically activated by a hydromechanical stored-energy spring mechanism, exhibit a constant time delay only in a narrow temperature range.

SUMMARY

An exemplary embodiment of the present disclosure provides a hydromechanical stored-energy spring mechanism for operating at least one switching contact of a circuit breaker, for example, in a high-voltage switching system. The exemplary hydromechanical stored-energy spring mechanism includes a hydraulically operated close-open (CO) delay circuit configured to delay triggering of a switching process of the circuit breaker, and an electromechanical actuator provided in place of a hydraulic operation of the CO delay circuit.

BRIEF DESCRIPTION OF THE DRAWING

Additional refinements, advantages and features of the present disclosure are described in more detail below with reference to exemplary embodiments illustrated in the drawing, in which:

The single drawing shows a schematic illustration of the functional interaction of functional elements of an electromechanical actuator according to an exemplary embodiment of the present disclosure.

DETAILED DESCRIPTION

Exemplary embodiments of the present disclosure provide a hydromechanical stored-energy spring mechanism for operating at least one switching contact of a circuit breaker of the type mentioned in the background part, where the hydromechanical stored-energy spring mechanism includes a delay device which meets the requirements of constancy of the time delay with as simple a design as possible.

According to an exemplary embodiment of the present disclosure, the hydromechanical stored-energy spring mechanism includes a hydraulically operated close-open (CO) delay circuit which delays triggering of the switching process of the circuit breaker. An electromechanical actuator is provided in place of the hydraulic operation of the CO delay circuit.

According to these features, an electromechanical actuator is provided in place of the hydraulic operation of the CO delay circuit. The electromechanical actuator has the function of generating a mechanical time delay or acceleration. In this case, the electromechanical actuator is in mechanical engagement with an electrical drive which operates a control unit of the electromechanical actuator.

An advantage associated with the present disclosure can be found substantially in the constant time delay or acceleration over an extended temperature range.

In accordance with an exemplary embodiment of the present disclosure, the electromechanical actuator includes a control unit, a timer unit, and a signaling unit. The units interact mechanically with one another. The control unit receives a rotary stimulus from the electrical drive as an input actuating variable. This rotary stimulus acts on the signaling unit and the timer unit. The signaling unitactivates the circuit breaker via an interface and triggers the switching process of the circuit breaker.

In accordance with an exemplary embodiment, the electrical drive which generates the rotary stimulus can engage with the electromechanical actuator in an interlocking manner, for example via a 4 kt shaft.

In accordance with an exemplary embodiment, the control unit and timer unit which form part of the electromechanical actuator are guided such that they can rotate independently of one another on a common rotation axis. In this case, the control unit has a driver disk which is acted on by the electrical drive.

In accordance with an exemplary embodiment, the driver disk is also provided with an outer contour, which determines the delay, for the transmission of the correspondingly delayed operation of the timer unit. For example, an operating cam can be integrally formed on the circumference of the driver disk, where this operating cam operates a locking unit at a predefined rotation angle of the driver disk.

In accordance with an exemplary embodiment, the driver disk can also be provided with a pin-like peg on its flat face. The pin-like peg serves to engage in a recess in the timer unit.

The abovementioned locking unit, which can be operated by the control unit or by the operating cam which is arranged on the control unit, can, according to an exemplary embodiment, of the present disclosure, be formed by a pivotable detent which interacts both with the control unit and with a latching device which is provided on the timer unit.

In accordance with an exemplary embodiment, the detent, which serves as a locking unit, can be in the form of a rectangular cuboid. The pivot axis about which the detent can be pivoted can be arranged along one edge of the rectangular cuboid. The opposite edge of the rectangular cuboid can be provided with a latching edge which firstly is acted on by the operating cam of the control unit, that is to say lifted counter to the latching direction, and secondly interacts with the latching device which is provided on the timer unit.

According to an exemplary embodiment of the present disclosure, the timer unit can include a flywheel which is mounted on the same axis as the driver disk and is provided with a local slotted-guide-like recess. This slotted-guide-like recess receives the pin-like peg which is provided on the driver disk for engagement in the slotted-guide-like recess. The transmission of the rotary movement of the driver disk established as a result ensures the flywheel is returned.

According to an exemplary embodiment of the electromechanical actuator of the present disclosure, provision is made for the timer unit to be acted on by an energy unit which can be in the form of a spring device which is operatively connected to the flywheel, which forms part of the timer unit, and acts on the flywheel in a rotation direction.

Furthermore, according to an exemplary embodiment of the present disclosure, the flywheel, which forms part of the timer unit, is provided with a cam-like integral feature on its circumference. The cam-like integral feature is provided to operate the signaling unit.

In accordance with an exemplary embodiment of the present disclosure, the signaling unit can include at least one switching element which is in the form of a normally closed contact or in the form of a normally open contact. The contacts are coupled to a switching rod to be operated. The switching rod is acted on by the timer unit. In this case, the signaling unit can be equipped with an interface which serves to activate the circuit breaker.

In accordance with an exemplary embodiment of the electromechanical actuator of the present disclosure, provision is made for at least one switching element which is in the form of a normally closed contact or in the form of a normally open contact to be formed by a spring contact which assumes a switching position, counter to the spring action, when the cam-like integral feature of the flywheel of the timer unit acts on the switching element. In this case, operation of the switching contacts is indirect, specifically by means of a switching rod which, depending on the type of switching contact in question, specifically depending on whether it is a normally closed contact or a normally open contact, presses down on or lifts off from, and respectively operates or releases, the contacts.

In other words, each switching contact in the switching element can be in the form of a normally closed contact or in the form of a normally open contact, with all the switching contacts being designed as contacts which are in each case loaded by a spring. These springs move the switching contact into the intended switching position, that is to say moving the normally closed contact into the open position and moving the normally open contact into the closed position. The switching contacts are then each operated or released by means of the mentioned switching rod.

In accordance with an exemplary embodiment of the present disclosure, provision can also be made for the switching element of the signaling unit to have a plurality of contacts. In this case, only one switching rod can likewise be provided for the purpose of operating the switching contacts, with the switching contacts then being activated by means of switching arms which are correspondingly integrally formed on the switching rod.

These and further advantageous refinements of and improvements to the present disclosure are described in more detail below.

Features, advantageous refinements of and improvements to the present disclosure as well as particular advantages of the present disclosure will now be explained in greater detail with reference to an exemplary embodiment of the disclosure which is illustrated in the appended drawing.

The single drawing shows a schematic illustration of the main components of the electromechanical actuator 10 according to an exemplary embodiment of the present disclosure which is operated as required by means of a drive shaft of an electrical drive. The contours or shapes of the main components schematically illustrated here may differ in terms of their specific design.

For the purpose of better understanding, the main components are moved away from one another in the drawing, in contrast to the actual, highly compact physical design, in order to clearly show their respective functions.

The abovementioned main components of the electromechanical actuator 10 include a control unit 12, a timer unit 14, an energy unit 16, a signaling unit 18 and a locking unit 20.

The control unit 12 and the timer unit 14 are arranged next to one another on a common axis 13 and can be rotated, in principle, independently of one another. Reference numerals 15.1 and 15.2 denote the symbolically illustrated bearing points of the common axis.

The control unit 12 has a driver disk 22 which, on the side which is remote from the viewer, is provided with a 4 kt holder for a dimensionally compatible drive shaft of the electrical drive.

The control unit 12 or the driver disk 22 is subjected to a rotary stimulus, which leads to the angular movement of the control unit 12 or driver disk 22, by means of the electrical drive or by means of the drive shaft of the electrical drive. The drive shaft is connected to the control unit 12.

The driver disk 22 is also provided with an integral feature locally on its circumference. The integral feature, as an operating cam 24, serves to act on the locking unit 20 which is in engagement which the driver disk 22.

A pin-like peg 26 is also arranged on the flat side, which faces the viewer, of the driver disk 22 of the control unit 12. The pin-like peg 26, for its part, serves to act on the timer unit 14 which is arranged on the same axis and closely beside the control unit 12 in the finally mounted state.

To this end, the timer unit 14 has a flywheel 28 which is arranged such that it can rotate on the same axis, that is to say on the common axis 13. The flywheel 28 is provided with a slotted-guide-like recess 30 on its axial end face. The abovementioned pin-like peg 26 engages in the slotted-guide-like recess 30 and, when the flywheel 28 is in a suitable angular position, transmits the rotary stimulus which is picked up by the driver disk 22 and accordingly acts on the flywheel 28.

In addition, an articulation point 32 is designed on the flywheel 28 and the energy unit 16, which is formed by a spring device 33 and acts on the flywheel 28 in the clockwise direction in the illustration shown, being articulated at the articulation point 32.

The flywheel 28 is also provided, on its outer contour, with a local integral feature which serves as a switching cam 34 for operating the signaling unit 18. The flywheel 28 is also provided with a latching device 36, which is formed by a series of latching notches 38 which are arranged on the circumference of the flywheel 28 or are made in the circumference of the flywheel and in which the locking unit 20 engages and, as a result, blocks a rotary movement of the flywheel 28.

The locking unit 20 is formed by a pivot bracket 40 which is mounted such that it can pivot about a pivot axis 42 which is arranged along the outer edge which is remote from the common rotation axis 13. The pivot bracket 40 is provided with a latching edge 44 on that outer edge which is opposite the pivot axis 42. The contour of the latching edge 44 is designed in such a way that it corresponds to that of the latching notches 38 in the flywheel 30.

The locking unit 20 or the pivot bracket 40 is also operatively contact-connected to the operating cam 24 which is integrally formed on the driver disk 22 of the control unit 12 and which, as a function of being acted on by the electrical drive, (not illustrated here), leaves the pivot bracket 40 in the position shown in the single FIGURE or pivots said pivot bracket upward due to corresponding rotation.

On account of this pivoting process, the pivot bracket 40 disengages from the latching apparatus 36. This disengagement of the pivot brake 30 leads to the flywheel 28 being released, and therefore the flywheel 28 following the force effect of the energy unit 16. In the event of this rotary movement which is triggered as a result, the switching cam 34 which is arranged on the flywheel 28 reaches the signaling unit 18 and acts on a switching rod 46.

The switching rod 46, which serves to operate a switching element 48 or the moving contact pieces 50, 52 which are associated with the switching element 48, is axially acted on by the switching cam 34, as a result of which the moving contact pieces 50, 52 are respectively switched and close or open the contact point 54, 56 in question.

The contact points 54, 56 are in the form of normally open contacts 54 or normally closed contacts 56, as required, with, in both cases, the contacts 54, 56 being provided with springs which accordingly move the contact in question to the closed or to the open position.

Accordingly, spring contacts in which the circuit is closed in the operated state, that is to say when they are acted on by the switching rod 46, are used in the case of normally open contacts 54. The circuit is opened due to rotation of the flywheel 28 and accordingly due to the accompanying spatial distance created between the switching cam 34 and the switching rod 46 since the spring of the spring contact lifts off the moving contact piece 54 from the contact point because its lifting movement is no longer limited by the switching cam 34. The spring contact is not operated in the switching state reached in this way.

Spring contacts are likewise used in the normally closed contact 56. In this case, in the event of operation by the switching rod 46 which is acted on by the switching cam 34, the springs of the moving contact 56 are prestressed and the circuit is opened.

The circuit is closed due to rotation of the flywheel 28 and accordingly due to the accompanying spatial distance created between the switching cam 34 and the switching rod 46 since the spring of the spring contact moves the moving contact 54 toward the fixed contact of the contact point because its lifting movement is no longer limited by the switching cam 34. The spring contact is not operated in the switching state reached in this way.

The functioning of the electromechanical actuator 10 according to the disclosure as a delay device will be explained below.

The electromechanical actuator 10 has the function of generating a mechanical time delay or acceleration. The electromechanical actuator 10 is controlled by means of a mechanical tap which forms an interface to the electrical drive on the control unit 12. A driver disk 22 is provided with the control unit 12.

This driver disk 22 has a specific outer contour and a driver pin 26. A latch (locking unit 20) is moved by means of the contour of the driver disk 22. The function of the latch 20 is to lock or to unlock a flywheel 28 (timer unit 14) using its latching means 38.

The driver pin 26 of the driver disk 22 has the function of moving the adjacent flywheel 28 by means of an inner contour and, as a result, tensioning a spring element 32 of the energy unit 16. The flywheel 28 is driven by this spring element 32.

Switching elements 48 (signaling unit 18) are guided on the outer contour of the flywheel 28. These switching elements 48 are kept open or closed depending on the position of the flywheel 28, and thereby transmit a signal to an interface to a circuit breaker. The required time delay or acceleration is generated by the flywheel 28 being unlocked, and a signal is triggered by means of the switching elements 48.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

10 Electromechanical actuator
12 Control unit
13 Axis, rotation axis
14 Timer unit
15.1 Bearing point
15.2 Bearing point
16 Energy unit
18 Signaling unit
20 Locking unit
22 Driver disk
24 Operating cam
26 Pin-like peg
28 Flywheel
30 Slotted-guide-like recess
32 Articulation point
33 Spring device
34 Switching cam
36 Latching device
38 Latching notches
40 Pivot bracket
42 Pivot axis
44 Latching edge
46 Switching rod
48 Switching element
50 Moving contact piece
52 Moving contact piece
54 Normally open contact
56 Normally closed contact

What is claimed is:

1. An electromechanical actuator for operating a close-open (CO) delay circuit configured to delay triggering of a switching process of a circuit breaker, the electromechanical actuator comprising:

a control unit;

a timer unit;

a locking unit; and a signaling unit, wherein:

the control, timer, locking and signaling units are configured to interact mechanically with one another;

the control unit includes a driver disk which is configured to be acted on by an electrical drive and is provided with an operating cam integrally formed on the circumference of the driver disk, which is configured to determine a delay for a correspondingly delayed operation of the timer unit;

the timer unit includes a flywheel which is provided with a local slotted-guide-like recess, the driver disk and the flywheel each being mounted on a common first axis and being rotatable about the first axis such that the driver disk and the flywheel are both mounted on and rotatable about the same first axis;

the driver disk is configured to act on the flywheel by means of a pin which is arranged on and extends from the driver disk for engagement in the slotted-guide-like recess, the pin extending between the driver disk and the slotted-guide-like recess of the timer unit along a second axis different from the common first axis on which both the driver disk and the flywheel are mounted and rotatable about;

the locking unit is configured to be operated by the control unit and to interact with a latching device which is provided on the timer unit and which is formed by a series of latching notches on the circumference of the flywheel, the locking unit being configured to lock or unlock the flywheel of the timer unit;

the locking unit is formed by a pivotable detent which is configured to interact with both the control unit and the latching device provided on the timer unit;

the timer unit includes a cam-like integral feature on its circumference, the cam-like integral feature being configured to operate the signaling unit;

the control unit is configured to receive a rotary stimulus as an input actuating variable;

the operating cam of the control unit is configured to operate the locking unit at a predefined rotation angle of the driver disk so that the pivotable detent of the locking unit disengages from the latching device of the timer unit, leading to the flywheel of the timer unit being released;

when the flywheel is in a suitable angular position, the pin of the driver disk which is engaged in the slotted-guide-like recess of the flywheel of the timer unit, transmits the rotary stimulus which was picked up by the driver disk of the control unit, and accordingly acts on the flywheel, so that the rotary stimulus acts on the timer unit and thereby on the signaling unit;

the signaling unit is configured to activate the circuit breaker via an interface and trigger the switching process of the circuit breaker; and wherein the pivotable detent is configured to disengage from one of the series of latching notches of the latching device and then engage with a sequential next one of the latching notches after the driver disk has completed a full revolution, such that the amount of delay is defined by a rotational speed of the driver disk and the number of latching notches.

2. The electromechanical actuator as claimed in claim 1, wherein the control unit and the timer unit are configured to rotate independently of one another on the common first axis.

3. The hydromechanical stored-energy spring mechanism as claimed in claim 2, wherein the flywheel of the timer unit is configured to be operated by the driver disk of the control unit by the pin which is arranged on the driver disk engaging in the slotted-guide-like recess which is provided on the flywheel and thereby acting on the flywheel.

4. The electromechanical actuator as claimed in claim 1, wherein the flywheel of the timer unit is configured to be operated by the driver disk of the control unit by the pin which is arranged on the driver disk engaging in the slotted-guide-like recess which is provided on the flywheel and thereby acting on the flywheel.

5. The electromechanical actuator as claimed in claim 4, comprising:

an energy unit configured to act on the timer unit.

6. The electromechanical actuator as claimed in claim 5, wherein the energy unit includes a spring device which is operatively connected to the flywheel and which is configured to act on the flywheel in a rotation direction.

7. The electromechanical actuator as claimed in claim 6, wherein the signaling unit includes at least one switching element which is in the form of one of a normally closed contact and a normally open contact, wherein the contact is coupled to a switching rod to be operated, wherein the switching rod is configured to be acted on by the timer unit, and wherein the signaling unit includes an interface which serves to activate the circuit breaker.

8. The electromechanical actuator as claimed in claim 7, wherein the at least one switching element which is in the form of one of a normally closed contact and a normally open contact is formed by a spring contact which assumes a switching position, counter to the spring action, when the cam-like integral feature of the flywheel of the timer unit acts on the switching element.

9. The electromechanical actuator as claimed in claim 1, comprising:

an energy unit configured to act on the timer unit.

10. The electromechanical actuator as claimed in claim 9, wherein the energy unit includes a spring device which is operatively connected to the flywheel and which is configured to act on the flywheel in a rotation direction.

11. The electromechanical actuator as claimed in claim 1, wherein the signaling unit includes at least one switching element which is in the form of one of a normally closed contact and a normally open contact, wherein the contact is coupled to a switching rod to be operated, wherein the switching rod is configured to be acted on by the timer unit, and wherein the signaling unit includes an interface which serves to activate the circuit breaker.

12. The electromechanical actuator as claimed in claim 11, wherein the at least one switching element which is in the form of one of a normally closed contact and a normally open contact is formed by a spring contact which assumes a switching position, counter to the spring action, when the cam-like integral feature of the flywheel of the timer unit acts on the switching element.

13. The electromechanical actuator as claimed in claim 1, wherein the circuit breaker is comprised in a high-voltage switching system.

14. The electromechanical actuator as claimed in claim 1, wherein the pin arranged on the driver disk is configured to interact with a slotted recess in the flywheel of the timer unit such that when the flywheel is in a particular angular position, a rotary stimulus of the driver disk acts on the flywheel.

* * * * *